US006262673B1

(12) United States Patent
Kalina

(10) Patent No.: US 6,262,673 B1
(45) Date of Patent: Jul. 17, 2001

(54) ROADWAY WARNING SYSTEM

(76) Inventor: Charleen L. Kalina, 2015 N. Dobson Rd., #4-227, Chandler, AZ (US) 85224

( * ) Notice: Subject to any disclaimer, the term of this patent is extended or adjusted under 35 U.S.C. 154(b) by 0 days.

(21) Appl. No.: 09/580,157

(22) Filed: May 30, 2000

(51) Int. Cl.[7] ..... G08G 1/00

(52) U.S. Cl. ..... 340/901; 340/905; 340/907; 340/916

(58) Field of Search ..... 340/901, 902, 340/905, 929, 904, 911, 323 R

(56) References Cited

U.S. PATENT DOCUMENTS

| | | | | |
|---|---|---|---|---|
| 2,968,802 | | 1/1961 | Flory et al. . | |
| 3,899,671 | * | 8/1975 | Stover | 235/150.2 |
| 4,816,827 | | 3/1989 | Baloutch et al. . | |
| 4,827,258 | * | 5/1989 | Evans | 340/929 |
| 5,126,735 | | 6/1992 | Trevijano . | |
| 5,280,632 | * | 1/1994 | Jung-Gon | 455/70 |
| 5,448,219 | | 9/1995 | Yoshikawa et al. . | |
| 5,519,390 | * | 5/1996 | Casini | 340/929 |
| 5,594,432 | | 1/1997 | Oliva et al. . | |
| 5,633,629 | | 5/1997 | Hochstein . | |
| 5,635,920 | * | 6/1997 | Pogue et al. | 340/901 |
| 5,784,006 | | 7/1998 | Hochstein . | |
| 5,940,010 | * | 8/1999 | Sasaki et al. | 340/901 |
| 6,087,962 | * | 7/2000 | Rojas | 340/907 |

* cited by examiner

*Primary Examiner*—Jeffery Hofsass
*Assistant Examiner*—Son Tang
(74) *Attorney, Agent, or Firm*—Schmeiser, Olsen & Watts

(57) ABSTRACT

A roadway warning system includes a visual traffic directing device that is at a first status for a first status time period and that is at a second status for a second status time period. A transmitter transmits a signal for a first signal time period, and a receiver mounted on the vehicle receives the signal. An indicator connected to the receiver indicates that the visual traffic directing device is either at the first status or is about to change to the first status so that a driver of the vehicle is warned of the present or future status of the visual traffic directing device. A method of warning a driver of a vehicle about the status of a visual traffic directing device includes transmitting a directional radio signal beginning at a predetermined time before the traffic directing device changes to a status, receiving the signal if the vehicle is approaching the traffic directing device from a first direction, and indicating that the visual traffic directing device is at the status or that the visual traffic directing device is about to change to the status by an audio message that is capable of being heard by the driver of the vehicle so that a driver of the vehicle is warned of the present or future status of the visual traffic directing device.

17 Claims, 4 Drawing Sheets

ROADWAY WARNING SYSTEM

BACKGROUND OF THE INVENTION

1. Technical Field

This invention generally relates to a roadway warning system, and more specifically relates to such a system that includes a transmitter for transmitting a signal regarding the status of a visual traffic directing device.

2. Background Art

Various systems and devices are used to direct traffic and to regulate the flow of traffic through intersections. Such systems typically use visual indicators such as lights and/or signs to communicate instructions to drivers of vehicles approaching intersections. For example, a typical traffic light includes a green light that tells a driver to proceed through the intersection, a yellow light that tells a driver that the light is about to turn red, and a red light that tells a driver to stop before reaching the intersection.

Present visual indicators generally work well. However, their reliance on the human visual sense is problematic because vehicle drivers are often inattentive, distracted, or are otherwise unaware of the message communicated by the visual indicators. Many intersection accidents result from the ineffectiveness of the reliance on the visual sense. Currently in the United States, operators are involved in approximately 1.8 million intersection accidents per year causing over 500,000 injuries of which approximately 7,000 involve fatalities.

Several different warning systems have existed that warn drivers of the status of visual traffic directing devices, such as traffic lights. Examples of such systems include U.S. Pat. No. 5,594,432 to Oliva et al., issued Jan. 14, 1997; U.S. Pat. No. 5,748,006 to Hochstein, issued Jul. 21, 1998; U.S. Pat. No. 5,635,920 to Pogue et al., issued Jun. 3, 1997; and U.S. Pat. No. 5,633,629 to Hochstein, issued May 27, 1997, each of which is incorporated herein by reference. Such systems have typically been complicated in operation and have not been sufficiently effective in warning drivers of upcoming traffic lights or other visual traffic directing devices.

DISCLOSURE OF INVENTION

According to the present invention, a roadway warning system includes a visual traffic directing device that is at a first status for a first status time period and that is at a second status for a second status time period. The visual traffic directing device is visible to a vehicle approaching the visual traffic directing device. A transmitter transmits a signal for a first signal time period, and a receiver mounted on the vehicle receives the signal. An indicator connected to the receiver indicates that the visual traffic directing device is either at the first status or is about to change to the first status so that a driver of the vehicle is warned of the present or future status of the visual traffic directing device. In one embodiment, the first signal time period begins a predetermined time before the first status time period begins.

The signal zone may be such that a vehicle approaching the intersection will exit the signal zone before reaching the intersection. Also, the signal zone may be such that the vehicle will enter the signal zone before the traffic directing device becomes visible to a driver of the vehicle. In one embodiment, an audio message indicating the status of the visual traffic directing device continues until either the transmitter stops emitting the signal, the vehicle leaves the signal zone, the first signal time period ends, or mute control is activated. The warning system may easily be adapted for use in multi-directional intersections.

The present invention also includes a method of warning a driver of a vehicle about the status of a visual traffic directing device. The method includes transmitting a directional radio signal beginning at a predetermined time before the traffic directing device changes to a status, receiving the signal if the vehicle is approaching the traffic directing device from a first direction, and indicating that the visual traffic directing device is at the status or that the visual traffic directing device is about to change to the status by an audio message that is capable of being heard by the driver of the vehicle so that a driver of the vehicle is warned of the present or future status of the visual traffic directing device.

The present invention may be easily implemented with existing components in a simple manner and it should be inexpensive to manufacture. With the present invention, a driver of a vehicle may receive notice of a red light well in advance of having to stop. If the audio message continues until the mute control is activated by a driver, the driver will continue to be warned until the driver comes to a conscious awareness of the present or future status of the traffic light.

The foregoing and other features and advantages of the invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, where like designations denote like elements.

MODES FOR CARRYING OUT THE INVENTION

Figure 1:
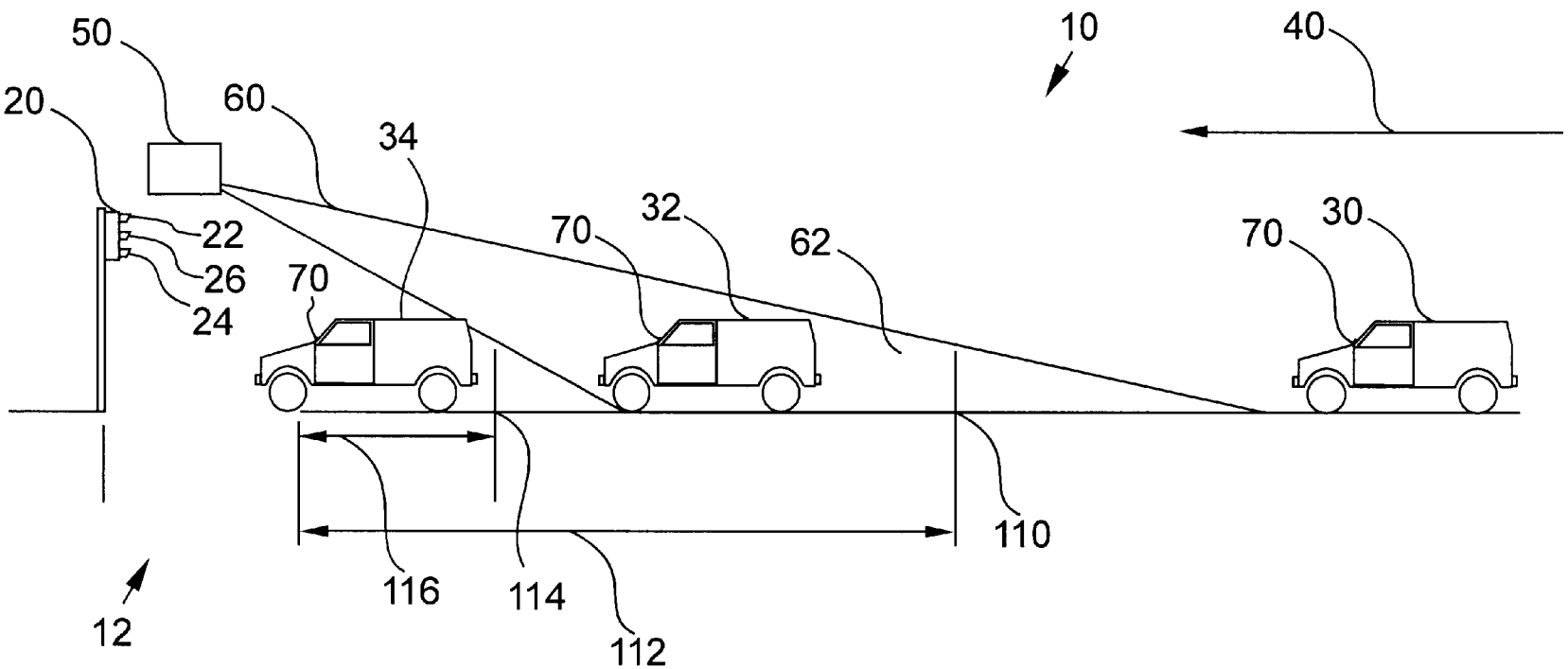
FIG. 1 is a side view of an intersection including a warning system according to an embodiment of the present invention.
Figure 2:
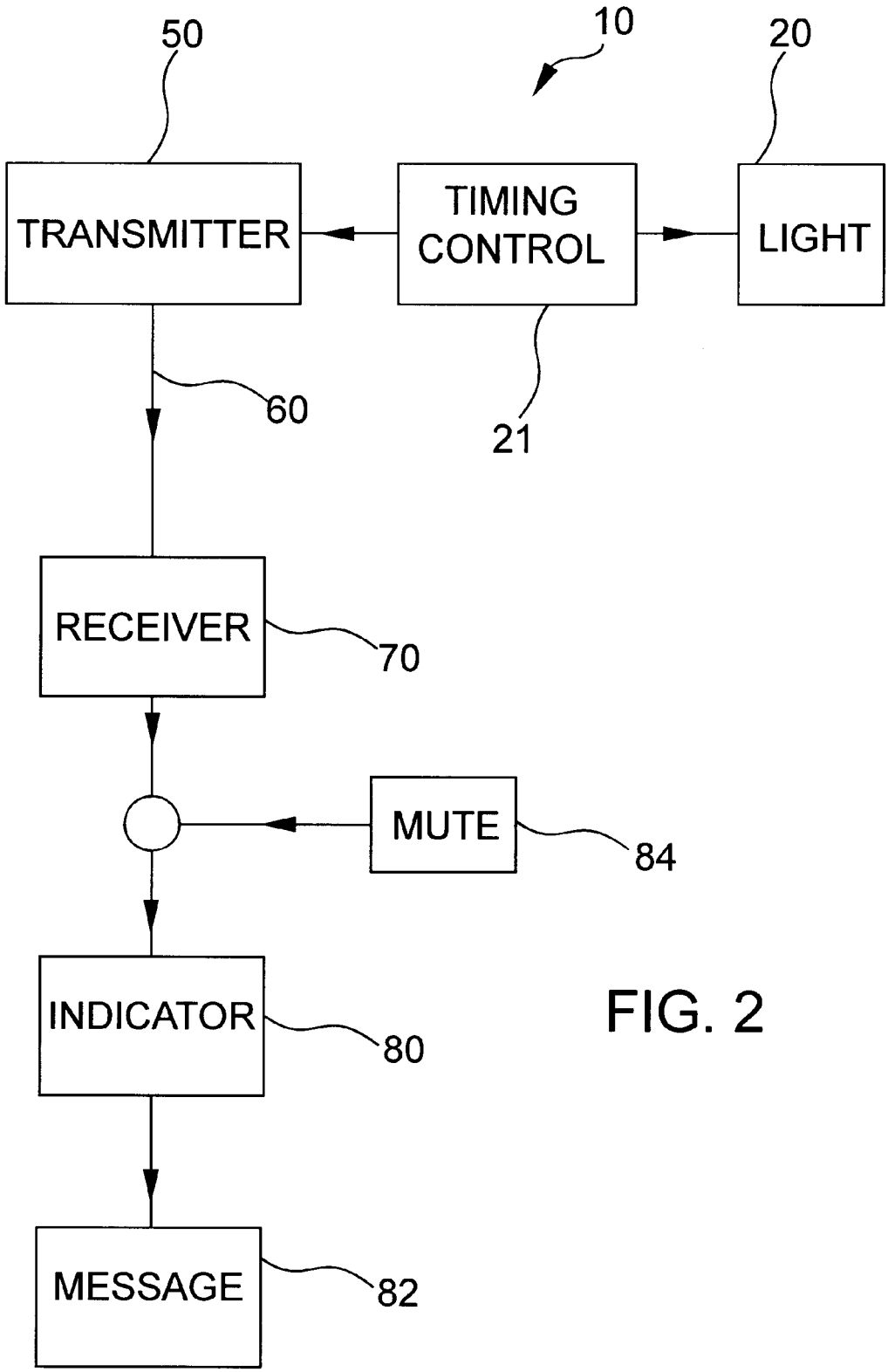
FIG. 2 is a schematic view of a warning system according to an embodiment of the present invention.

Referring to FIGS. 1–2, a preferred embodiment of the roadway warning system 10 includes an intersection 12 that is directed by a visual traffic directing device or traffic light 20. A typical intersection includes several such traffic lights, each of which is connected to a timing control 21. The traffic light preferably includes a red light 22, a green light 24, and a yellow light 26. Timing control 21 prompts traffic light 20 to periodically change between a first status wherein red light 22 is on, a second status wherein green light 24 is on, and a third status wherein yellow light 26 is on. Traffic light 20 is preferably visible to drivers of vehicles 30, 32, 34 that are approaching intersection 12 in a first direction 40. Such vehicles preferably view traffic light 20 and if traffic light 20 is red or is about to turn red, the vehicles stop before reaching intersection 12. However, such vehicles proceed through intersection 12 if traffic light 20 is green.

Warning system 10 also includes a transmitter 50 that transmits a signal 60 in a signal zone 62. Transmitter 50 is preferably connected to timing control 21, which prompts transmitter 50 to emit signal 60. A receiver 70 is preferably mounted on each vehicle 30, 32, 34 so that such a receiver 70 will receive signal 60 while receiver 70 is in signal zone 62. An indicator 80 is preferably connected to each receiver 70 so that the indicator 80 will convey an audio message 82 to a driver of vehicle 30, 32, 34 indicating the present or future status of traffic light 20. Preferably, audio message 82 will continue until either signal 60 changes, receiver 70 leaves signal zone 62, or a driver of vehicle 30, 32, 34 activates a mute control 84. Moreover, preferably, audio message 82 will warn a driver of vehicle 30, 32, 34 of a status of traffic light 20, such as a red light, even before traffic light 20 is at that status. In this way, a driver of a vehicle 30, 32, 34 will receive notice of a red light well in advance of having to stop. Because audio message 82 continues until mute control 84 is activated by a driver, the driver will continue to be warned until the driver comes to a conscious awareness of the present or future status of the traffic light 20. Also, signal zone 62 may be such that the driver will be warned even before traffic light 20 becomes visible to the driver.

Referring still to FIGS. 1–2 and describing warning system 10 in more detail, intersection 12 preferably is an intersection between adjoining streets, but it may be an intersection between a pathway and a street or some other type of intersection. Also, it is to be understood that the present invention will produce advantageous results in conjunction with visual traffic directing devices even where such devices are not located at an intersection. The intersection preferably includes the intersection between the streets as well as any adjoining crosswalks.

Visual traffic directing device 20 preferably includes a traffic light, but it may include any of several other types of visual devices, especially such devices that periodically change from one status to another. Preferably, traffic light 20 includes a red light 22, a green light 24, and a yellow light 26. However, it may include only a green and red light or it may be some other type of traffic light.

Transmitter 50 is preferably a directional transmitter that produces a signal 60 only within a signal zone 62. Accordingly, transmitter 50 may be a laser or infrared transmitter. However, such transmitters would not allow reception of signal 60 by receiver 70 unless there was a line of sight between transmitter 50 and receiver 70. Thus, signal 60 could be easily blocked by a high profile vehicle in front of receiver 70, and receiver 70 would not be able to receive signal 60 until about the same time that the driver of vehicle 30, 32, 34 could view traffic light 20. Accordingly, transmitter 50 is preferably a directional radio transmitter that will produce a radio signal 60 in a defined signal zone 62. Transmitter 50 is shown at intersection 12 in FIG. 1, but it may be at some other location near intersection 12.

Signal 60 may include only a single signal type or it may include a pre-status signal that indicates traffic light 20 is about to change to a status and a status signal that indicates traffic light 20 is at a status. Also signal 60 may include several pre-status signals and several status signals at different times that indicate different present and future statuses of traffic light 20.

Signal zone 62 preferably begins at a starting point 110 (where a receiver 70 will enter signal zone 62) located a first distance 112 from intersection 12, and ends at an ending point 114 (where a receiver 70 will leave signal zone 62) located a second distance 116 from intersection 12. Thus, when a vehicle such as vehicle 30 is farther than first distance 112 from intersection 12, it will be out of signal zone 62 and the corresponding receiver 70 will not receive signal 60. When a vehicle such as vehicle 32 is closer to intersection 12 than first distance 112, the corresponding receiver 70 will receive signal 60. When a vehicle such as vehicle 34 is closer to intersection 12 than second distance 116, the corresponding receiver 70 will no longer receive signal 60.

Preferably, first distance 112 is such that an average driver driving an average vehicle at a posted speed limit at the location of intersection 12 will have ample opportunity after reaching starting point 110 to become aware of the status of traffic light 20, react to that status, and stop before reaching intersection 12, if necessary. In a preferred embodiment, starting point 110 is beyond the range where traffic light 20 would be visible to a driver of a vehicle. Preferably, second distance 116 is such that an average driver driving an average vehicle at a posted speed limit at the location of intersection 12 after reaching ending point 114 will no longer have time to react and stop before reaching intersection 12. Also, signal zone 62 is preferably only within lanes of traffic that are approaching traffic light 20 in first direction 40 so that other vehicles and drivers will not receive false alarms from warning system 10.

Each receiver 70 is preferably a directional receiver that receives the type of signal that is emitted by transmitter 50. Thus, in a preferred embodiment, each receiver 70 is a directional radio receiver that is tuned to receive the same frequency of radio being emitted from transmitter 50. Because each receiver 70 and each transmitter 50 are both preferably directional, false alarms should be minimized by warning system 10. Preferably, a specific frequency of radio will be allocated for roadway warning systems such as the one described herein so that receivers will not get false alarms from other types of transmitters.

Receiver 70 is preferably connected to indicator 80, such as by wiring. Indicator 80 preferably includes an amplifier and a speaker that will emit an audio message 82 that is capable of being heard by the driver of vehicle 30, 32, 34. Any of several existing amplifiers and speakers are sufficient. Also, indicator 80 may include the speakers already existing for the sound system of vehicle 30, 32, 34. Audio message 82 is preferably a voice message that indicates the present or future status of traffic light 20. For example, audio message 82 may state "RED LIGHT AHEAD," "LIGHT AHEAD ALMOST RED," "STOP SIGNAL AHEAD," or "STOP AHEAD." However, audio message 82 may be a non-voice message such as a bell or a beep.

Audio message 82 preferably continues, such as by repeating message 82, until mute control 84 is activated. After mute control 84 is activated, preferably by a driver, indicator 80 will cease emitting audio message 82 while receiver 70 remains in signal zone 62. After receiver 70 leaves signal zone 62, mute control 84 preferably automatically resets so that indicator 80 will again emit an audio message 82 when receiver 70 reenters signal zone 62 or enters another signal zone. The continuing message and mute features force a driver of vehicle 30, 32, 34 to perform an affirmative act before audio message 82 ceases. In this way, the driver will be forced to come to his/her senses and be attentive to the status of light 20.

Figure 3:
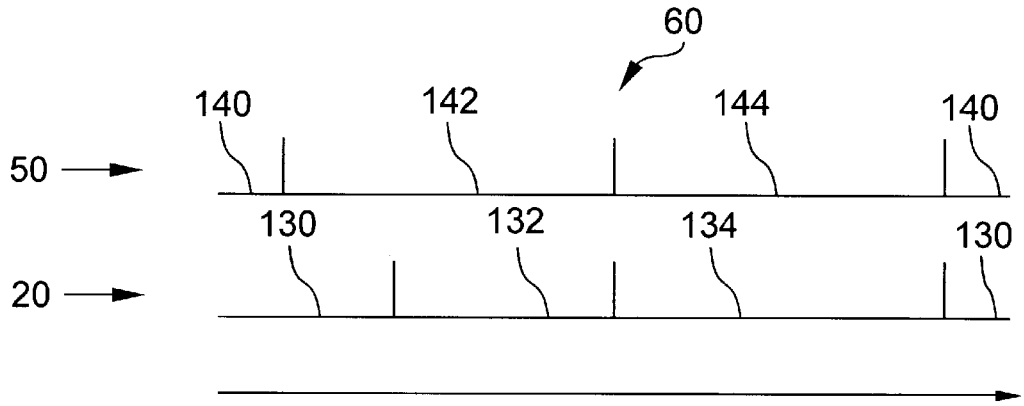
FIG. 3 is a time line depicting the timing of an audio message and a visual traffic directing device.
Figure 4:
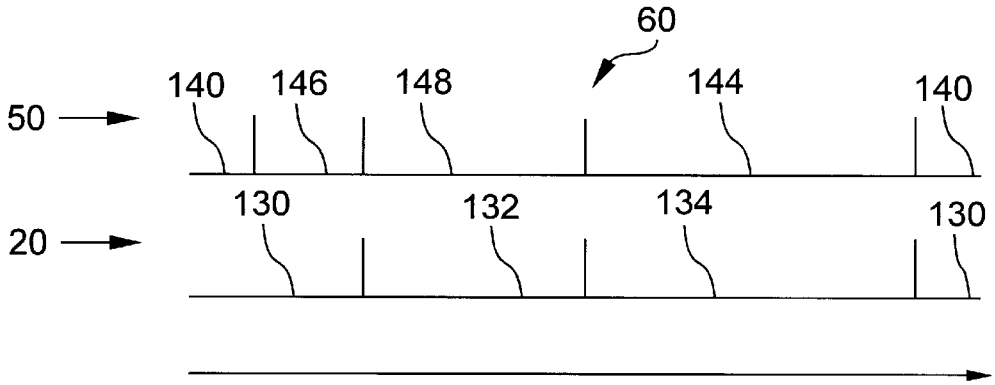
FIG. 4 is a time line depicting the timing of an audio message and a visual traffic directing device.
Figure 5:
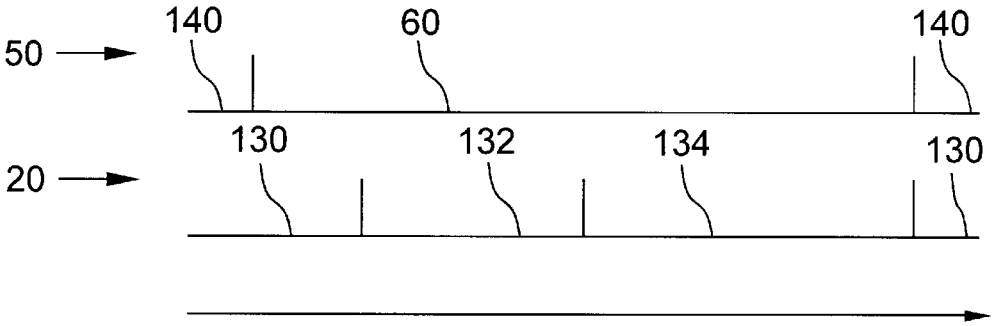
FIG. 5 is a time line depicting the timing of an audio message and a visual traffic directing device.

FIGS. 3–5 are time lines depicting several different embodiments of the correlation between the timing of signal 50 and the status of traffic light 20, with FIG. 5 depicting the preferred embodiment. Referring to FIG. 3, traffic light 20 begins at a green light status 130, changes to a yellow light status 132, changes to a red light status 134, and changes back to green light status 130. Transmitter 50 begins at a no signal status 140, wherein it does not emit a signal, and then transmits a signal 60 that begins as a pre-status red light signal 142 indicating that traffic light 20 is about to change to red light status 134. Signal 60 then changes to a status red light signal 144 indicating that traffic light 20 is at red light status 134. Then, when traffic light 20 changes from red light status 134 to green light status 130, transmitter 50 changes back to no signal status 140. This cycle preferably repeats indefinitely. It should be noted that the timing of pre-status red light signal 142 will change depending on the speed limit at the intersection, and may or may not precede yellow light status 132.

Referring to FIG. 4, traffic light 20 again begins at a green light status 130, changes to a yellow light status 132, changes to a red light status 134, and changes back to green light status 130. Transmitter 50 begins at a no signal status 140, wherein it does not emit a signal, and then transmits a signal 60 that begins as a pre-status yellow light signal 146 indicating that traffic light 20 is about to change to yellow light status 132. Signal 60 then changes to a status yellow light signal 148 indicating that traffic light 20 is at yellow light status 132. When traffic light 20 changes from yellow light status 132 to red light status 134, transmitter 50 changes to status red light signal 144, indicating that traffic light 20 is at red light status 134. When traffic light 20 changes from red light status 134 back to green light status 130, transmitter 50 changes back to no signal status 140. This cycle preferably repeats indefinitely. Again, the timing of the signals will depend on the features of the particular intersection.

Referring now to FIG. 5, traffic light 20 again begins at a green light status 130, changes to a yellow light status 132, changes to a red light status 134, and changes back to green light status 130. Transmitter 50 begins at a no signal status 140, wherein it does not emit a signal, and then transmits a signal 60 beginning at a predetermined time before traffic light 20 changes to red light status 134. Signal 60 is a single signal that indicates traffic light 20 is about to change to red light status 134 or is at red light status 134. As with the previously described embodiments, the timing of signal 60 will depend on the features of the particular intersection. Those skilled in the art will recognize from these embodiments that many other embodiments may also be implemented with the present invention. For example, signal 60 may also include a status green light signal that indicates that traffic light 20 is at a green light status 130.

Referring back to FIG. 1, as vehicle 30 approaches intersection 12 in first direction 40, it will begin out of the signal zone 62 and will not receive signal 60 whether signal 60 is being transmitted or not. Upon entering signal zone 62 vehicle 32 is in position to receive signal 60 and receiver 70 of vehicle 32 will receive signal 60 unless transmitter 50 is at a no signal status as described above. Upon receiving signal 60, message 82 (see FIG. 2) will continue until either signal 60 changes (in which case message 82 will change), transmitter 50 changes to no signal status 140 (see FIGS. 3–5), mute control 84 is activated (see FIG. 2), or the receiver 70 leaves signal zone 62 as with vehicle 34.

Figure 6:
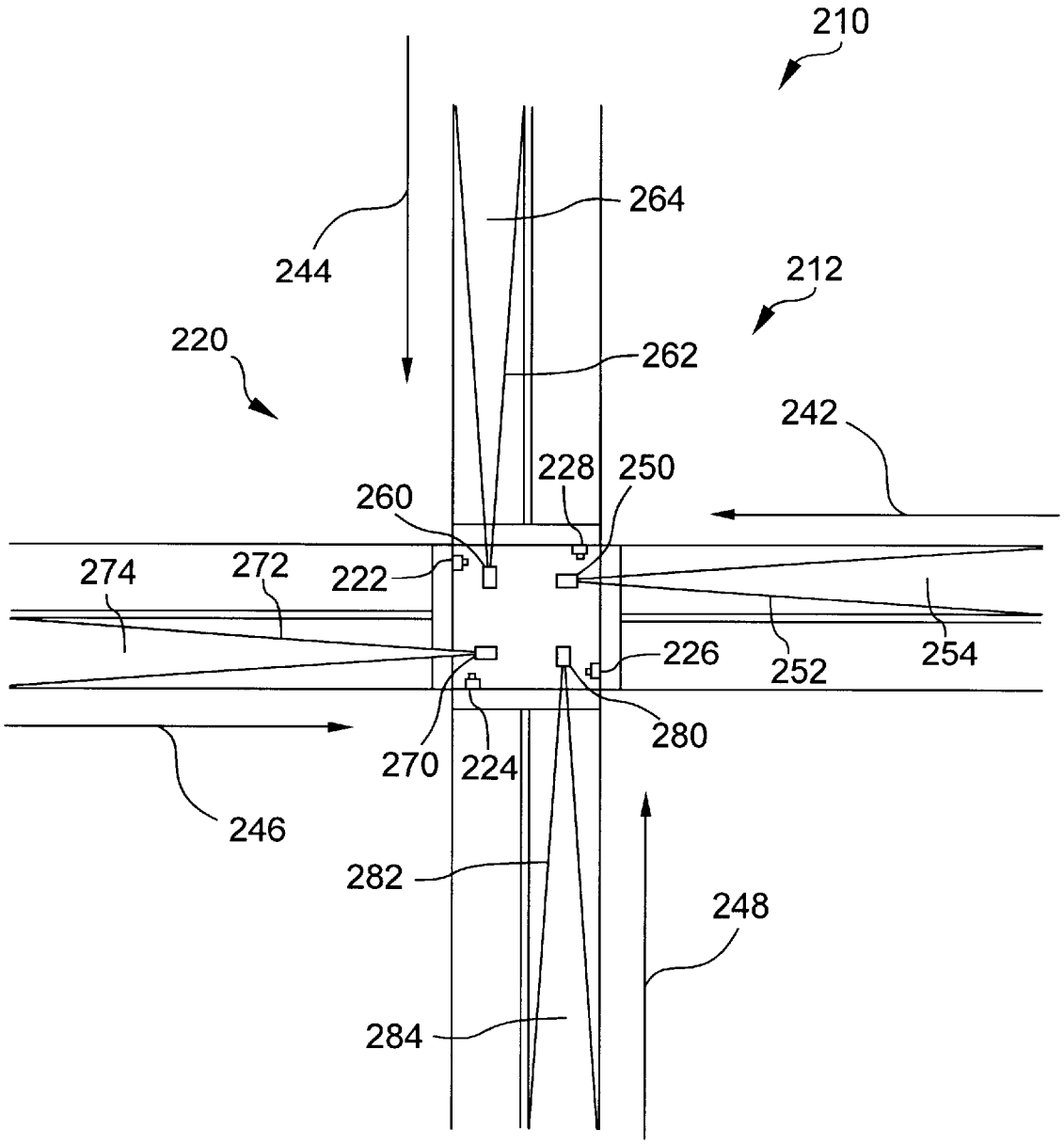
FIG. 6 is a top view of a four-way intersection including a warning system according to the present invention.

Referring now to FIG. 6, a warning system 210 is shown at a four-way intersection 212, wherein traffic drives on the right side of the road as in the United States. Visual traffic directing device 220 includes a first traffic light 222, a second traffic light 224, a third traffic light 226, and a fourth traffic light 228, all of which are preferably connected to a timing control. Vehicles entering intersection 212 in a first direction 242 can view and are directed by first traffic light 222, vehicles entering intersection 212 in a second direction 244 can view and are directed by second traffic light 224, vehicles entering intersection 212 in a third direction 246 can view and are directed by third traffic light 226, and vehicles entering intersection 212 in a fourth direction 248 can view and are directed by fourth traffic light 228. A first transmitter 250 emits a first signal 252 within a first signal zone 254 that can be received by receivers mounted on vehicles entering intersection 212 in first direction 242. A second transmitter 260 emits a second signal 262 within a second signal zone 264 that can be received by receivers mounted on vehicles entering intersection 212 in second direction 244. A third transmitter 270 emits a third signal 272 within a third signal zone 274 that can be received by receivers mounted on vehicles entering intersection 212 in third direction 246. A fourth transmitter 280 emits a fourth signal 282 within a fourth signal zone 284 that can be received by receivers mounted on vehicles entering intersection 212 in fourth direction 248. Other than being multidirectional, warning system 210 operates similarly to operating system 10 described above. Those skilled in the art will appreciate that a single multi-directional transmitter may be used, rather than separate transmitters 250, 260, 270, and 280 as shown in FIG. 6.

Signal zones 254, 264, 274, 284 preferably taper outwardly to form a conical area (see also FIG. 1). However, the signal zones may be any of various shapes depending in the types of transmitters used and the particular features of the intersection.

While the invention has been particularly shown and described with reference to preferred embodiments thereof, it will be understood by those skilled in the art that various changes in form and details may be made therein without departing from the spirit and scope of the invention.

What is claimed is:

1. A roadway warning system comprising:

a visual traffic directing device that is at a first status for a first status time period and that is at a second status for a second status time period, the visual traffic directing device being visible to a vehicle approaching the visual traffic directing device in a first direction;

a transmitter that transmits a signal for a first signal time period;

a receiver mounted on the vehicle, the receiver receiving the signal;

an indicator connected to the receiver that indicates that the visual traffic directing device is either at the first status or is about to change to the first status so that a driver of the vehicle is warned of the present or future status of the visual traffic directing device, wherein the indicator only indicates that the receiver is receiving the signal when the receiver is in a signal zone, the signal zone having a starting point located a first distance from the visual traffic directing device and an ending point located a second distance from the visual traffic directing device such that the vehicle traveling in the first direction will pass both the starting point and the ending point before reaching the visual traffic directing device, whereby the indicator leaves the signal zone before reaching the visual traffic directing device; and wherein the first signal time period begins a predetermined time before the first status time period begins.

2. The system of claim 1, wherein the receiver only receives the signal if the vehicle is approaching the visual traffic directing device from a first direction.

3. The system of claim 1, wherein the signal zone is only within traffic lanes wherein vehicles are approaching the visual signal indicator from the first direction.

4. The system of claim 1, wherein a vehicle traveling in the first direction will enter the signal zone at a first distance from an intersection that is directed by the traffic directing device and will exit the signal zone at a second distance from the intersection.

5. The system of claim 4, wherein the second distance is located such that the vehicle will leave the signal zone at a point where an average operator driving an average vehicle at a posted speed limit will not have time to stop before reaching an intersection that is directed by the traffic directing device.

6. The system of claim 4, wherein the first distance is such that the vehicle will enter the signal zone before the traffic directing device becomes visible to a driver of the vehicle.

7. The system of claim 1, wherein the indicator is an audio indicator that sounds an audio message indicating that the traffic directing device is at the first status or is about to change to the first status.

8. The system of claim 7, wherein the indicator includes a mute control, wherein the receiver only indicates that the receiver is receiving the signal when the receiver is in a signal zone, and wherein the audio message continues until either the vehicle leaves the signal zone, the first signal time period ends, or the mute control is activated.

9. The system of claim 1, wherein the signal is a directional radio signal.

10. A roadway warning system comprising:

a visual traffic directing device that is at a first status for a first status time period and that is at a second status for a second status time period, the visual traffic directing device being visible to a vehicle if the vehicle approaches the visual traffic directing device from a first direction;

a first transmitter that transmits a first directional radio signal during a first signal time period;

a receiver mounted on the vehicle, the receiver receiving the first signal only if the vehicle is approaching the traffic directing device from the first direction; and an audio indicator connected to the receiver, such that when the receiver receives the first signal, the indicator indicates by an audio message that the visual traffic directing device is at the first status or that the visual traffic directing device is about to change to the first status so that a driver of the vehicle is warned of the present or future status of the visual traffic directing device;

wherein the indicator includes a mute control, wherein the indicator only indicates that the receiver is receiving the first signal when the receiver is in a signal zone, the signal zone having a starting point located a first distance from the visual traffic directing device and an ending point located a second distance from the visual traffic directing device such that the vehicle traveling in the first direction will pass both the starting point and the ending point before reaching the visual traffic directing device, whereby the indicator leaves the signal zone before reaching the visual traffic directing device; and wherein the audio message continues until either the vehicle leaves the signal zone, the first signal time period ends, or the mute control is activated.

11. The system of claim 10, wherein the transmitter begins transmitting the signal a predetermined time before the first status time period.

12. The system of claim 11, wherein the first signal zone is such that the vehicle will leave the first signal zone at a point where an average operator driving an average vehicle at a posted speed limit at an intersection that is directed by the traffic directing device will not have time to stop before reaching the intersection;

wherein the signal zone is only within traffic lanes wherein vehicles are approaching the visual signal indicator from the first direction; and wherein the vehicle will enter the signal zone before the traffic directing device becomes visible to a driver of the vehicle.

13. The system of claim 12, wherein the first signal includes a first pre-status signal before the first status time period that indicates the traffic directing device is about to change to the first status and that prompts the audio indicator to emit a pre-status message, and wherein the first signal further includes a first status signal during the first status time period that indicates the traffic directing device is at the first status and that prompts the audio indicator to emit a status message.

14. The system of claim 13, wherein the traffic directing device includes a first traffic light visible to the vehicle approaching the traffic directing device from the first direction, and a second traffic light visible to a vehicle approaching the traffic directing device from a second direction, the second traffic light being timed to coincide with the first traffic light for orderly traffic flow through the intersection;

wherein the first status comprises the first traffic light being red;

wherein the second status comprises the second traffic light being red;

wherein the roadway warning system further comprises a second transmitter that transmits a second directional radio signal during a second signal time period;

wherein the second transmitter begins transmitting the second signal a predetermined time before the second status time period;

wherein the receiver receives the second signal only if the vehicle is approaching the traffic directing device from the second direction;

wherein, when the receiver receives the second signal, the indicator indicates that the visual traffic directing device is at the second status or that the visual traffic directing device is about to change to the second status by an audio message;

wherein the indicator only indicates that the receiver is receiving the second signal when the receiver is in a second signal zone, the second signal zone being such that the vehicle will exit the second signal zone before the vehicle reaches a point where an average operator driving an average vehicle at a posted speed limit at the intersection that is directed by the traffic directing device will not have time to stop before reaching the intersection;

wherein the second signal zone is only within traffic lanes wherein vehicles are approaching the visual signal indicator from the second direction;

wherein the vehicle will enter the second signal zone before the traffic directing device becomes visible to a driver of the vehicle;

wherein the second audio message continues until either the vehicle leaves the second signal zone, the second signal time period ends, or the mute control is activated;

wherein the second signal includes a second pre-status signal before the second status time period that indicates the traffic directing device is about to change to the second status and that prompts the indicator to emit the pre-status message; and wherein the second signal further includes a second status signal during the second status time period that indicates the traffic directing device is at the second status and that prompts the indicator to emit the status message.

15. A method of warning a driver of a vehicle about the status of a visual traffic directing device, the method comprising the steps of:

transmitting a directional radio signal beginning at a predetermined time before the traffic directing device changes to a status;

receiving the signal if the vehicle is approaching the traffic directing device from a first direction; and indicating that the visual traffic directing device is at the status or that the visual traffic directing device is about to change to the status by an audio message that is capable of being heard by the driver of the vehicle so that a driver of the vehicle is warned of the present or future status of the visual traffic directing device, wherein the indicating step is performed only when the receiver is in a signal zone, the signal zone having a starting point located a first distance from the visual traffic directing device and an ending point located a second distance from the visual traffic directing device such that a vehicle traveling in the first direction will pass both the starting point and the ending point before reaching the visual traffic direction device, whereby the indicator leaves the signal zone before reaching the visual traffic directing device.

16. The method of claim 15, wherein the audio message continues until either the vehicle leaves the signal zone, the traffic directing device changes from the status, or a mute control is activated.

17. The system of claim 16, wherein the second distance is located such that the vehicle will leave the signal zone at a point where an average operator driving an average vehicle at a posted speed limit will not have time to stop before reaching an intersection that is directed by the traffic directing device.

* * * * *